US005275225A

United States Patent [19]

Marasco et al.

[11] Patent Number: 5,275,225

[45] Date of Patent: Jan. 4, 1994

[54] SWAG SUPPORT

[75] Inventors: Angelo M. Marasco, Madison; John W. LeClaire, Middleton; James A. Raisbeck, Waunakee, all of Wis.

[73] Assignee: Springs Window Fashions Division, Inc., Middleton, Wis.

[21] Appl. No.: 983,379

[22] Filed: Nov. 30, 1992

[51] Int. Cl.[5] ..... A47H 13/14

[52] U.S. Cl. ..... 160/348; 160/349.2; 16/108

[58] Field of Search ..... 160/348, 349.1, 349.2, 160/330, 38; 16/108

[56] References Cited

U.S. PATENT DOCUMENTS

| | | | |
|---|---|---|---|
| 2,236,017 | 3/1941 | Stratton . | |
| 2,244,129 | 6/1941 | Stratton . | |
| 2,409,425 | 10/1946 | Falkenberg | 160/348 |
| 2,606,733 | 8/1952 | Krajewski . | |
| 3,022,819 | 2/1962 | Lampret | 160/345 |
| 3,119,442 | 1/1964 | Ford et al. | 160/345 |
| 3,203,469 | 8/1965 | Falkenberg . | |
| 3,370,819 | 2/1968 | Kenney | 160/345 X |
| 3,417,807 | 12/1968 | Falkenberg . | |
| 3,545,523 | 12/1970 | Falkenberg | 160/348 |
| 3,901,303 | 8/1975 | Falkenberg . | |

*Primary Examiner*—Blair M. Johnson

*Attorney, Agent, or Firm*—Vernon J. Pillote

[57] ABSTRACT

A swag support comprising an elongated tubular rod and a longitudinal slot at the rear side of the rod. Each swag holder includes a head portion mounted in the slot in the rod; an arm portion extending upwardly from the head and a C-shaped front portion that extends from the arm portion over the top of the rod and in spaced relation to the front and bottom of the rod and terminates in the distal end spaced from the bottom of the rod to allow a fabric swag scarf to be introduced into the swag holders from below the rod. Each swag holder has a fabric clip for holding an upper portion of the fabric swag scarf at a rear side of the rod and each swag holder also has a plurality of fingers on an inner side of the C-shaped front portion which define a plurality of fabric fold receiving slots at spaced locations along the C-shaped front portion.

15 Claims, 1 Drawing Sheet

SWAG SUPPORT

BACKGROUND OF THE INVENTION

Various different swag support systems have heretofore been made for supporting the fabric swag or festoon over a window opening. Some such as disclosed in U.S. Pat. Nos. 2,236,017 and 2,244,129 mount festoon rings on a curtain rod or on the curtain rod brackets at the end of the rod. In U.S. Pat. No. 2,606,733, upwardly opening U-shaped swag support brackets are mounted at the front side of the curtain rod. U.S. Pat. Nos. 3,203,469; 3,417,807 and 3,901,303 disclose swag holders that are mounted by independent brackets and arranged so that the swag hangs in front of the curtain rod to conceal the rod. In swag supports using ring-type swag holders, it is necessary to insert an end portion of the fabric through each ring and some difficulties are encountered in forming the desired fold or configuration in the rings while equalizing the length of the side drops of the swag and forming the desired curve or drape between the rings. The swag holders in U.S. Pat. Nos. 3,203,469; 3,417,807 and 3,901,303 provide fingers on the rear side of the holder to form slots for receiving folds in the fabric to facilitate pleat formation. However, the swag holders in these patents are neither constructed or adapted for supporting a swag on a curtain rod.

Various objects in the present invention are to provide a system for supporting a drapery swag over a window opening having an improved swag holder which facilitates mounting of the swag holders on a curtain rod; enables loading of a fabric swag in the swag holders from a location below the rod; which supports an upper portion of the fabric swag at a rear side of the rod, and which facilitates pleating and draping of the fabric swag.

Accordingly, the present invention provides a swag support comprising an elongated tubular rod having face wall means defining the top, front and bottom of the rod, and upper and lower rear wall portions spaced apart and defining a longitudinal slot at the rear side of the rod. At least two swag holders are mounted on the rod and each swag holder includes a head portion disposed in the slot, and an arm portion extending upwardly from the head portion C-shaped front portion substantially larger than the rod cross-section, the C-shaped front portion extending from the arm portion over the top of the rod and in spaced relation to the front and bottom of the rod and terminating in the distal end spaced from the bottom of the rod to allow a fabric swag scarf to be introduced into the swag holders from below the rod. Each swag holder advantageously includes a fabric clip for holding an upper portion of the fabric swag scarf at a rear side of the rod. Each swag holder also advantageously has a plurality of fingers on an inner side of the C-shaped front portion which define a plurality of fabric fold receiving slots at spaced locations along the C-shaped front portion.

DESCRIPTION OF THE PREFERRED EMBODIMENT

The swag support of the present invention in general includes an elongated curtain rod 10 and a plurality of swag holders 11 mounted on the rod for supporting a fabric swag S over the top of and along the sides of a window opening W. The rod comprises two or more tubular telescopically adjustable sections to enable adjustment of the length of the rod in a selected range, to accommodate window openings of different width.

Figure 1:
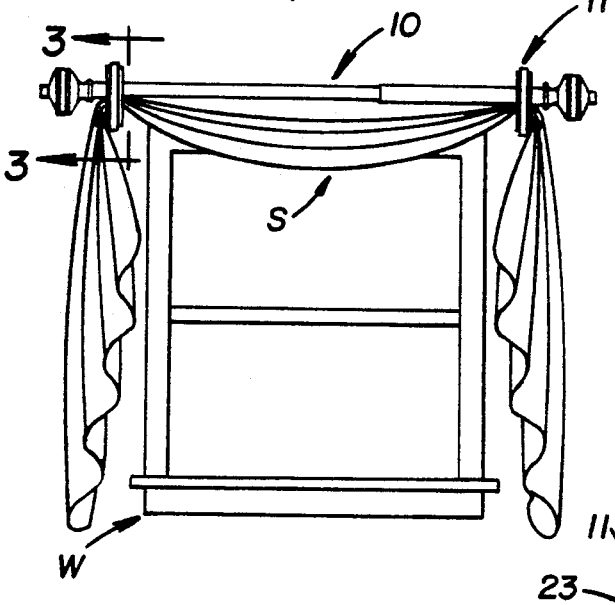
FIG. 1 is a front elevational view illustrating use of the swag support of the present invention supporting a fabric swag over a window opening.
Figure 2:
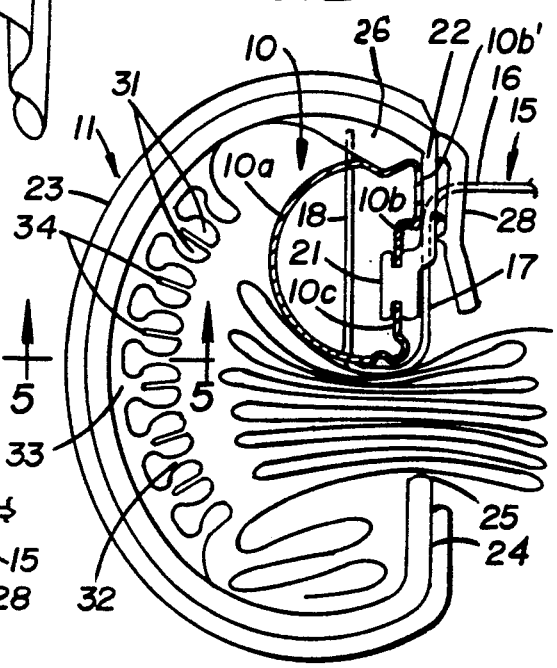
FIG. 2 is a cross-sectional view through the rod and illustrating loading of a fabric swag into one of the swag holders.
Figure 3:
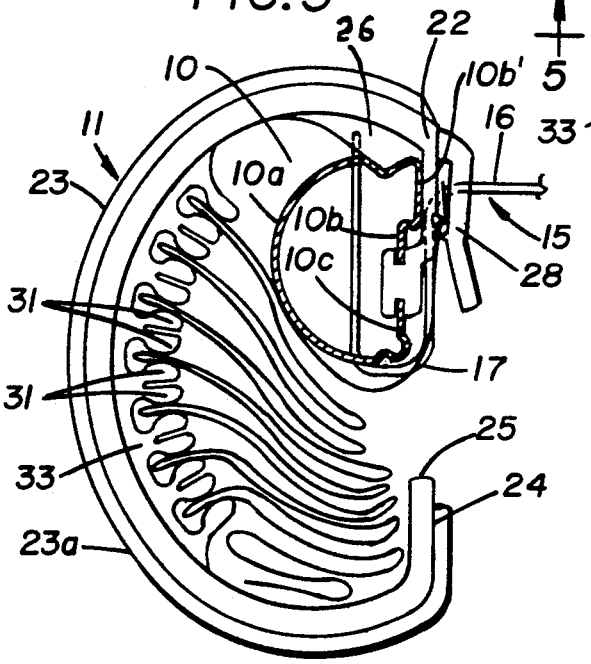
FIG. 3 is a cross-sectional view through the rod taken on the plane 3—3 of FIG. 1 and illustrating a fabric swag scarf assembled on one of the swag holders.
Figure 4:
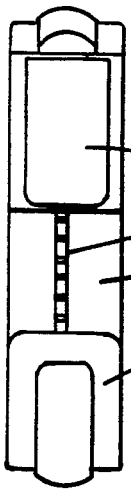
FIG. 4 is a rear view of a swag holder.
Figure 5:
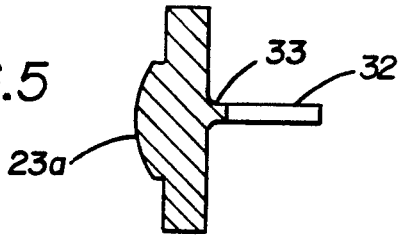
FIG. 5 is a fragmentary transverse sectional view taken on the plane 5—5 of FIG. 2.

As shown in FIGS. 2 and 3, the tubular rod has a face wall 10*a* of generally C-shaped cross-section which define the top, front and bottom of the rod, and an upper and lower rear wall portions 10*b* and 10*c* that are spaced apart to define a longitudinal slot at the rear of the rod. In the present invention, it is contemplated that at least a portion of the face wall of the rod be exposed to view and the face wall is accordingly provided with a decorative shape and finish. In the embodiment illustrated, the upper rear wall portion 10*b* is shaped to form a mounting rail 10*b*'.

The rod 10 is mounted on a wall or window casing by wall brackets 15 of conventional construction. The brackets 15 illustrated herein are of the type shown in U.S. Pat. No. 3,951,195 in which the forward portion of the support arm 16 is formed with an upper opening saddle including a leg 17 that extends downwardly at the rear side of the rod and a leg 18 that extends upwardly through the openings in the rod. The support brackets can also be of the type shown in U.S. Pat. No. 3,470,578, in which jaws are provided on the forward end of the support arm arranged to engage the rail 10*b*' at the rear of the rod.

The swag holders include a head portion 21 disposed in the slot and having upper and lower recesses for receiving the upper and lower rear wall portions 10*b* and 10*c* as shown in FIGS. 2 and 3. The swag holders have an upper rear portion 22 that extends upwardly from the head portion 21, and a generally C-shaped front portion 23 that is substantially larger than the rod cross-section. The C-shaped front portion extends from the arm portion over the top of the rod and in spaced relation to the front and bottom rod, and the C-shaped portion 23 has an upwardly extending rear portion 24 that terminates in a distal end 25 spaced below the bottom of the rod a substantial distance sufficient to allow a folded or gathered portion of the swag scarf S to be introduced laterally into the swag holder from a location below the bottom of the rod. The head 21 is preferably arranged to closely receive the upper and lower wall portions and frictionally retain the holder at a pre-adjusted position along the rod and at a fixed orientation crosswise of the rod. As shown in FIGS. 2 and 3, the upwardly extending wall portion 22 of the holder is advantageously arranged to engage the upper rear wall portion 10*b* of the rod to aid in inhibiting movement of the holder relative to the rod. In addition, the C-shaped portion is preferably provided with a rib 26 at its inner side arranged to engage the top of the rod to support the swag holder on the top of the rod.

While it is desirable to arrange the swag so as to drape in a graceful arc, it is important to hold the upper edge of the fabric above the bottom of the rod to inhibit passage of light between the bottom of the rod and the top of the swag. A fabric clip 28 is provided on the upper rear portion of the swag holder for receiving an upper portion of the fabric swag. As shown, the fabric clip is arranged to open or face downwardly as shown in FIGS. 2 and 3 and comprises a finger formed integrally with the swag holder at its upper end and which extends downwardly adjacent the upper rear portion 22 for gripping an upper edge portion of the fabric scarf S.

A plurality of fingers 31 are provided on the inner side of the C-shaped portion to define a plurality of fabric fold receiving notches 32 at spaced locations along the inner side of the C-shaped portion. In the preferred embodiment illustrated, each holder has a thin web portion 33 extending inwardly along the inner side of the arcuate portion 23, and the fabric fold receiving notches 32 are formed by reentrant notches in the web with the portions of the web between the notches defining inwardly extending fingers. The notches 32 are preferably formed with enlarged inner ends and flared outer ends as shown in FIGS. 2 and 3, and slots 34 are provided in the web between adjacent notches to a depth adjacent the enlarged inner portions of the notches so that the fingers 31 are resiliently bendable in a direction laterally of the notches.

At least the C-shaped portion 23 of the swag holders is exposed to view during use and the swag holders are preferably formed with a decorative configuration and coating. In the embodiment illustrated, the C-shaped portion of the swag holder has a central rib 23*a* that is rounded in cross-section, it being understood that other cross-sectional configurations could be used if desired.

From the foregoing it is believed that the construction and method of using the swag support will be readily understood. The curtain rod is adjusted to the desired length according to the width of the window opening and the rod is mounted by conventional rod mounting brackets 15 on a support surface such as a wall or window casing. The rod mounting brackets are preferably of the adjustable type so as to enable positioning of the rod 10 forwardly of any other window or curtain treatment. The swag holders 11 are mounted on the rod by inserting the head 21 into the slot at the rear of the rod and the swag holders can be mounted on the rod either before or after the rod is mounted on the rod support bracket. A swag holder is mounted adjacent each end of the rod and in long rods or for different swag treatments, additional swag holders can be mounted on the rod at locations intermediate the ends of the rod. The swag scarf which has been previously sized to span the width of the opening and provide side drops of the desired length at each side of the opening, is then hand folded or pleated and inserted laterally into the swag holder from a location below the rod at the rear side thereof as shown in FIG. 2. The swag scarf can then be adjusted lengthwise relative to the swag holders to equalize the side drop portions of the swag. An upper portion of the swag is inserted into the fabric clip to hold the upper edge portion of the fabric at the rear side of the rod and the upper edge of the swag can be drawn taut between the swag holders to inhibit drooping of the upper edge of the swag below the rod. The folds in the fabric scarf can thereafter be inserted into the fabric receiving slots on the curved portion of the rod to provide an orderly arrangement of the pleats with the remaining portion of the swag resting on the bottom of the swag holder. The swag holders are frictionally retained by the heads in the manually adjusted or set positions along the rod and the fingers 31 engage the folds in the fabric so that the amount of drape of the fabric folds between the swag holders can be adjusted to provide the desired drape or arc between the holders.

The embodiments of the invention in which an exclusive property or privilege is claimed are defined as follows:

1. A swag support comprising an elongate tubular rod having face wall means defining the top, front and bottom of the rod and upper and lower rear wall portions spaced apart to define a longitudinal slot at a rear side of the rod, at least two swag holders spaced apart along the rod, each swag holder including a head portion disposed in the slot and an arm portion extending upwardly from the head portion and a generally C-shaped front portion substantially larger than the rod cross section, the C-shaped front portion extending from the arm portion over the top of the rod and in spaced relation to the front and bottom of the rod, the C-shaped front portion having a distal end portion spaced from the bottom of the rod to allow a fabric swag scarf to be introduced into the swag holders from below the rod.

2. A swag support according to claim 1 wherein each swag holder includes fabric clip means for holding an upper portion of a fabric swag scarf at a rear side of the rod.

3. A swag support according to claim 1 wherein each swag holder includes downwardly facing fabric clip means for holding an upper portion of a fabric swag scarf at a rear side of the rod.

4. A swag support according to claim 2 wherein the clip means includes a finger formed integrally with the arm portion and extending downwardly adjacent a rear side of the arm portion.

5. A swag support according to claim 1 wherein each swag holder includes a plurality of fingers on an inner side of the C-shaped front portion defining a plurality of fabric fold receiving notches at spaced locations along the C-shaped portion.

6. A swag support according to claim 5 wherein the fingers are resiliently bendable in a direction laterally of the slots.

7. A swag support according to claim 1 wherein each swag holder includes downwardly facing fabric clip means for holding an upper portion of a fabric swag scarf at a rear side of the rod, and a plurality of fingers on an inner side of the C-shaped portion defining a plurality of fabric fold receiving notches at spaced locations along the C-shaped front portion.

8. A swag support according to claim 1 wherein said head portion has upper and lower slots for receiving adjacent portions of the upper and lower rear wall portions.

9. A swag support according to claim 1 wherein said arm portion engages the rear wall portion of the rod.

10. A swag support according to claim 1 wherein the C-shaped front portion of the swag holder has means engaging the face wall of the rod means adjacent the top of the rod.

11. A swag holder for use on a curtain rod having spaced edges defining a lengthwise extending slot at the rear of the rod, the swag holder including a head portion having a recess for receiving an edge of the rod; an arm portion extending upwardly from the head portion; and a generally C-shaped front portion extending forwardly and downwardly from the arm portion and terminating in a distal end portion spaced from the head portion, fabric clip means on the arm portion at a rear side thereof, and a plurality of fingers on an inner side of the C-shaped front portion defining a plurality of fabric fold receiving notches at spaced locations along the C-shaped front portion.

12. A swag holder according to claim 11 wherein the fabric clip means faces downwardly.

13. A swag holder according to claim 11 wherein said fingers are resiliently bendable in a direction laterally of the slots.

14. A swag holder according to claim 11 wherein the holder has a thin web portion extending along an inner side of the C-shaped front portion, the web portion having said fingers therein and said fabric fold receiving notches between adjacent fingers, the fold receiving notches having enlarged inner ends and flared outer ends, and slots in the web portion between adjacent fold receiving notches and extending to a depth adjacent the enlarged inner ends of the fold receiving notches to provide resilient fingers, the fingers being spaced forwardly from the arm portion and the distal end portion of the holder.

15. A drapery swag holder comprising, a generally C-shaped front portion and upper and lower arm portions extending toward each other at a rear side of the front portion, the upper and lower arm portions having ends spaced from each other a distance sufficient to allow insertion of a folded fabric swag therethrough into the C-shaped front portion, the holder having a thin web portion extending along an inner side of the C-shaped front portion, the web portion having a plurality of re-entrant openings therein providing spaced fabric fold receiving notches and intermediate web sections between adjacent fold receiving notches, the fold receiving notches having enlarged inner ends and flared out ends, and slot means in the intermediate web sections between adjacent fold receiving notches and extending to a depth adjacent the enlarged inner ends of the fold receiving notches for dividing each intermediate web section into a pair of fabric engaging fingers each resiliently bendable in a direction laterally of a adjacent one of the fold receiving notches, the fingers having distal ends spaced forwardly from the upper and lower rear arm portions of the holder.

* * * * *

UNITED STATES PATENT AND TRADEMARK OFFICE

CERTIFICATE OF CORRECTION

PATENT NO. : 5,275,225

DATED : Jan. 4, 1994

INVENTOR(S) : Angelo M. Marasco, John W. LeClaire, James A Raisbeck

It is certified that error appears in the above-identified patent and that said Letters Patent is hereby corrected as shown below:

Claim 15, column 6, line 16, delete "out" and insert -- outer --;

Claim 15, column 6, line 18 after "depth" insert -- less than the fabric receiving notches and --

Claim 15, column 6, line 21 delete "a" and insert -- an --.

Signed and Sealed this

Third Day of May, 1994

Bruce Lehman

*Attest:*

BRUCE LEHMAN

*Attesting Officer*

*Commissioner of Patents and Trademarks*